United States Patent [19]

Knuepfer

[11] Patent Number: 4,992,042

[45] Date of Patent: Feb. 12, 1991

[54] MULTIPURPOSE LIGHTER

[75] Inventor: Reiner Knuepfer, Poecking, Fed. Rep. of Germany

[73] Assignee: ERKA GmbH, Poecking, Fed. Rep. of Germany

[21] Appl. No.: 330,753

[22] Filed: Mar. 30, 1989

[30] Foreign Application Priority Data

Mar. 31, 1988 [DE] Fed. Rep. of Germany ..... 3811161

[51] Int. Cl.[5] ..... F23D 21/00

[52] U.S. Cl. ..... 431/253; 401/52; 401/195; 206/385

[58] Field of Search ..... 431/253; 401/49, 52, 401/82, 87, 195, 34; 206/385; 131/178

[56] References Cited

U.S. PATENT DOCUMENTS

| | | | |
|---|---|---|---|
| 1,749,565 | 3/1930 | Coryell | 401/52 X |
| 2,720,966 | 10/1955 | Davis | 206/385 X |
| 2,815,123 | 12/1957 | Safianoff | 401/87 |

FOREIGN PATENT DOCUMENTS

| | | | |
|---|---|---|---|
| 806411 | 3/1951 | Fed. Rep. of Germany | 431/253 |
| 561260 | 10/1923 | France | 431/253 |
| 942730 | 2/1949 | France | 431/253 |
| 943028 | 2/1949 | France | 401/52 |

*Primary Examiner*—Carl D. Price

*Attorney, Agent, or Firm*—Foley & Lardner, Schwartz, Jeffery, Schwaab, Mack, Blumenthal & Evans

[57] ABSTRACT

A multipurpose lighter with a container for liquefied gas or other fuel, and an igniting mechanism arranged on the upper side of the container, the container having in its lower region a partition defining a lower hollow space for a lipstick. The lipstick can be extended or advanced as it is used to continually provide an exposed surface when a closing cap at the bottom of the lighter is removed.

10 Claims, 1 Drawing Sheet

MULTIPURPOSE LIGHTER

BACKGROUND OF THE INVENTION

The invention relates to a multipurpose lighter including a container for a liquefied gas or some other fuel, and an igniting mechanism arranged on the upper side of the container.

Multipurpose lighters, in particular disposable lighters, which are combined with various other useful articles, for example a clock or a ballpoint pen, are known.

Disposable lighters and lipstick casings generally have a very similar external form. This frequently leads to them being confused, in particular when they are in a purse or the pocket of a garment; i.e. when looking for the lighter the lipstick is found, and vice versa.

SUMMARY OF THE INVENTION

It is therefore an object of the present invention to provide a multipurpose lighter of the type mentioned, but which avoids mistaken identification of lipstick and lighter.

This object is achieved in accordance with the invention by incorporating in the lower region of the container a partition defining a lower hollow space to receive a lipstick. The advantageous effect achieved with such a design is that the lighter and the lipstick are designed as one item, so that no matter whether it is wished to use the lighter or the lipstick, the correct item is always at hand.

Advantageously, the lipstick can comprise a creamy lipstick for protection of the lips, such as is frequently used, for example, in intensive sunlight. This does away with mistaken identification of the protective lipstick and lighter, particularly troublesome when skiing where relatively thick clothing is a hindrance.

In a further advantageous aspect of the invention, the lipstick is arranged displaceable in the hollow space. This makes it possible to accommodate a greater quantity of the lipstick, since, when the portion of the stick then exposed is used up, it is possible to extend or advance it further.

Finally, it is provided that the hollow space can be closed by an end cap. This has the effect of preventing the lipstick from becoming soiled.

BRIEF DESCRIPTION OF THE DRAWINGS

An exemplary embodiment of the invention is described in more detail below and is represented in the drawing, in which.

DETAILED DESCRIPTION OF THE PREFERRED EMBODIMENTS

Figure 1:
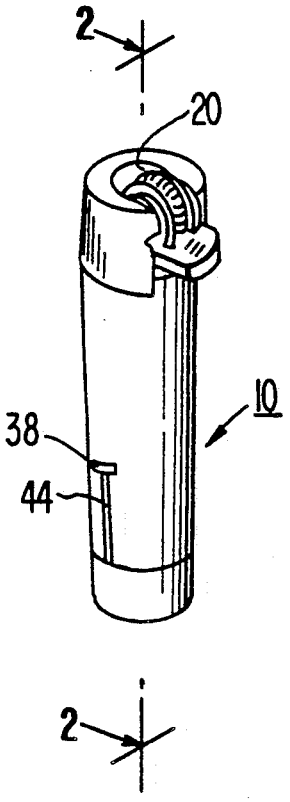
FIG. 1 shows a perspective view of the multipurpose lighter.
Figure 2:
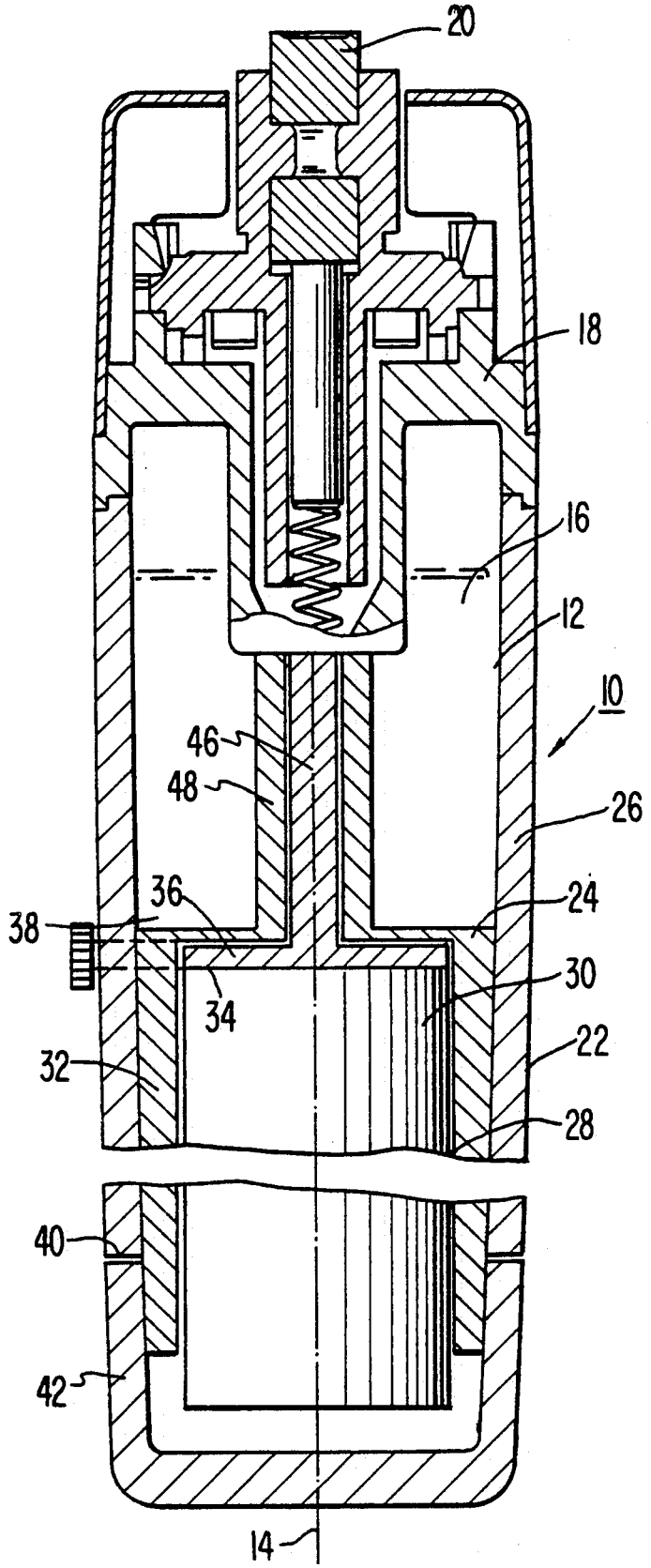
FIG. 2 shows a sectional view of the multipurpose lighter along the line 2—2 in FIG. 1.

FIG. 1 shows a multipurpose lighter 10 which substantially corresponds in its outer dimensions to a typical disposable lighter. The multipurpose lighter 10 has a container 12 defining a reservoir for liquefied gas 16 or some other fuel, and an igniting mechanism 20 arranged on the upper end 18 of the container. In the lower region 22 of the container 12, there is arranged a partition 24, which sealably closes off the container 12 for the liquified gas 16 so that the container is gas-tight and pressure-tight in the downward direction. The peripheral wall 26 of the container extends downwardly a suitable length beyond the partition 24, thereby outwardly defining a hollow space 28 for receiving a lipstick 30, preferably a creamy lipstick for protection of the lips.

The lipstick 30 is positioned in a cylindrical guide 32 mounted within the wall 26 and the hollow space 28, with the lower end 34 of the lipstick lying on a plate 36. The plate can be displaced back and forth in the guide 32 in a longitudinal direction, i.e. in the direction of the longitudinal axis line 14, by means of a pin 38, which can be operated from the outside. The cylindrical guide 32 extends downwardly beyond the bottom of the peripheral wall 26 of the container, with the bottom surface of the wall forming a shoulder 40.

The open end below the bottom of the lipstick 30, shoulder 40, and guide 32 can be closed by an end cap 42, located over the section of the cylindrical guide 32 extending beyond the peripheral wall 26 of the container. The cap can be pushed on the guide 32 until it engages the shoulder 40. The end cap 42 is held on the bottom section of the cylindrical guide 32 by means of frictional clamping. However, it is possible, by providing a thread, to screw the end cap 42 onto the section of the cylindrical guide 32.

In order that the pin 38 can be displaced along the peripheral wall 26 of the container, a slot 44 is provided in the peripheral wall 26 of the container, and a similar slot is formed in the guide 32.

The lower plate 36 for the lipstick 30 is provided on its underside with a guide pin 46, which is arranged in a central guide 48 extending into the container 12. As a result, a tilting of the lipstick 30 during pushing back and forth in the cylindrical guide 32 by means of the pin 38 is avoided. This is particularly important since the lipstick 30 is substantially softer than the cylindrical guide 32 and a tilting of the lipstick 30 could damage it.

It is likewise possible, instead of pushing the lipstick 30 back and forth by means of the pin 38 in connection with the plate 36, to displace the lipstick 30 by means of a thread of large pitch, the thread being driven in a known way. Furthermore, the cylindrical guide 32 does not necessarily have to be cylindrical. A rectangular or square guide is likewise possible.

What is claimed is:

1. A multipurpose lighter comprising;

(a) a container having first and second opposed ends and a peripheral wall defining a reservoir for liquified gas or other suitable fuel, and an igniting mechanism arranged at the first end of the container for igniting the gas, (b) a partition mounted in said container relatively adjacent the second end, said partition sealing off the liquified gas contained in said reservoir, said partition and said peripheral wall defining a hollow space in said second end of said container, (c) a lipstick mounted in said hollow space, and (d) a central guide extending from said partition into said reservoir, support means located within said hollow space for supporting said lipstick, and a guide pin connected to said support means and extending into said central guide, whereby said lipstick is precluded from tilting.

2. The lighter of claim 1, further including a guide positioned in said hollow space and defining with said partition a space for receiving the lipstick.

3. The lighter of claim 2, wherein said support means comprises a plate mounted within said guide between said partition and said second end and against which the lipstick rests at its inner end, and wherein said guide pin is mounted on an underside of said plate.

4. A multipurpose lighter comprising;

(a) a container having first and second opposed ends and a peripheral wall defining a reservoir for liquified gas or other suitable fuel, and an igniting mechanism arranged at the first end of the container for igniting the gas, (b) a partition mounted in said container relatively adjacent the second end, said partition sealing off the liquified gas contained in said reservoir, said partition and said peripheral wall defining a hollow space in said second end of said container, (c) a lipstick mounted in said hollow space, (d) a guide positioned within said hollow space and defining with said partition a space for receiving the lipstick, and (e) a central guide extending from said partition into said reservoir, a plate mounted within said guide between said partition and said second end and against which the lipstick rests at its inner end, and a guide pin mounted on an underside of said plate and extending into said central guide, whereby said lipstick is precluded from tilting in said guide.

5. The lighter of claim 1, further including guide and said partition are integrally formed.

6. The lighter of claim 1, further including an end cap frictionally mounted around an end of said guide and adapted to engage an end surface of said peripheral wall which constitutes a shoulder.

7. The lighter of claim 4, further including means operatively connected to said plate and exposed exteriorly of said peripheral wall for longitudinally advancing or retracting said plate and thus the lipstick.

8. The lighter of claim 7, wherein said peripheral wall and said guide are formed with aligned, longitudinal slots to accommodate movement of said advancing means.

9. The lighter of claim 4, wherein said central guide, said partition and said guide are integrally formed, and said guide pin is integrally formed with said plate.

10. The lighter of claim 4, wherein said lipstick is a protective cream for protection of the lips.

* * * * *